United States Patent [19]

Carrera

[11] Patent Number: 4,496,921

[45] Date of Patent: Jan. 29, 1985

[54] ELECTROMAGNETIC ACTUATOR HAVING ADJUSTABLE PLUNGER

[75] Inventor: Jacinto P. Carrera, Chestnut Hill, Mass.

[73] Assignee: Polaroid Corporation, Cambridge, Mass.

[21] Appl. No.: 398,760

[22] Filed: Jul. 15, 1982

[51] Int. Cl.[3] ..... H01F 7/08

[52] U.S. Cl. ..... 335/258; 335/263; 335/273

[58] Field of Search ..... 335/251, 255, 258, 261, 335/262, 263, 270, 273, 279

[56] References Cited

U.S. PATENT DOCUMENTS 1,361,935 12/1920 Villiers .
2,333,448 11/1943 Seeley ..... 335/273 X
2,992,304 7/1961 Andrews ..... 335/273 X

*Primary Examiner*—George Harris
*Attorney, Agent, or Firm*—Leslie J. Payne

[57] ABSTRACT

An adjustable electromagnetic actuator is disclosed which is operable to control the displacement of a movable workpiece member. Included in the actuator is a coil assembly including means defining a bore and an energizeable field coil which surrounds the bore. An armature assembly movable in the bore includes a plunger and an output assembly which is adapted to be connected to the workpiece. Means operatively associated with one of the output member or the plunger restrains rotational movement of said one with respect to the other. Included is an arrangement which connects the output assembly to the plunger for allowing the plunger and the output assembly to move conjointly along a given axis and for allowing relative rotation therebetween when said one cooperates with the restraining means and the other of the plunger or the output assembly is rotated such that they are displaced in relationship to each other along the given axis to thereby allow stroke regulation of the armature assembly.

11 Claims, 2 Drawing Figures

ELECTROMAGNETIC ACTUATOR HAVING ADJUSTABLE PLUNGER

BACKGROUND OF THE INVENTION

This invention relates to actuators of the electromagnetic type and, more particularly, to electromagnetic actuators in which the travel of the movable armature is adjustable.

Electromagnetic actuators have been used for a wide variety of purposes. One type that has been used in a number of applications is a so-called voice coil or moving coil motor. In motors of this type, when a current is applied to a coil positioned in a magnetic field, with a segment of the coil perpendicular to the field, a force is exerted on the coil segment. The direction of this force is dependent upon the direction of current flow and the direction of the magnetic field.

Another kind of conventional electromagnetic actuator is referred to commonly as a solenoid. To date a wide variety of useful solenoids have been proposed for performing a multitude of functions. In such solenoids reverse polarization of coil windings will result in reverse axial translation of a magnetically permeable armature disposed within the core of the winding. U.S. Pat. Nos. 1,361,935 and 3,940,726 are representative of such kinds of solenoids. Still another type of electromagnetic actuator is described in commonly-assigned U.S. Pat. Nos. 3,868,712 and 4,008,448 issued, respectively, to C. Biber and J. Muggli. Electromagnetic actuators of this type have been found to be extremely useful for driving shutter blades, in a photographic apparatus. In such apparatus, it is desired to have the shutter blades accurately displaced by a plunger of the actuator for desired exposure control. However, in the camera assembly process, seldom are the shutter blades and the electromagnetic actuator joined together in such a fashion that the travel of the actuator plunger will result in the desired shutter blade displacement. Accordingly, the actuator must be adjusted to provide for the correct plunger travel.

One known approach for adjusting the stroke of the plunger is through use of an adjustable plug. More specifically, the plug is threadedly connected to the coil assembly of the actuator and has one end which contacts and limits plunger movement. To adjust the stroke of the plunger, the plug is threadedly advanced inwardly or outwardly with respect to the coil assembly. However, use of threaded plugs gives rise to problems in obtaining optimum actuator performance. This is because threaded connections usually have air gaps between otherwise complementary threaded surfaces. Such gaps add undesirably to the magnetic impedance of the system and results in a less efficient actuator.

Besides, actuators of the last-noted type have plungers which are susceptible of being dislodged easily therefrom. This adds to problems of camera assembly especially when the plunger is to be coupled to the shutter blades.

SUMMARY OF THE INVENTION

It is an object of the present invention to overcome the shortcomings mentioned above in regards to electromagnetic actuators. In this regard, the present invention provides for an improved adjustable electromagnetic actuator. Included in such actuator is a coil assembly including means for defining a bore at least partially therethrough and having a given axis. This assembly includes an energizeable field coil at least partially surrounding the bore. Disposed in the bore is an armature assembly including a plunger which is movable along the given axis in response to energization of the field coil. The armature assembly includes an output assembly which is adapted to be connected to a workpiece. Restraining means are operationally associated with one of the output assembly or the plunger for restraining rotational movement of said one with respect to the other. Connecting the output assembly to the plunger is means for allowing them to move conjointly along the given axis and for allowing relative rotation therebetween when one of the output assembly or plunger cooperates with the restraining means and the other of the output assembly or plunger is rotated. In this manner, they are displaceable in relationship to each other along the given axis to thereby allow stroke regulation of the armature assembly.

In an illustrated embodiment, the restraining means is defined by a pair of spaced-apart trapping members being connected adjacent one end portion thereof to the coil assembly. The output assembly includes means for engaging the trapping members, whereby the output assembly is non-rotational during stroke regulation and is also maintained in preselected angular orientation for facilitating assembly thereof to the workpiece. The trapping members trap the armature assembly to the coil assembly. This advantageously allows the coil assembly, plunger unit and the output member to be a self-contained unit. The foregoing arrangements facilitate easy coupling of the output member to a shutter mechanism during camera assembly.

In another illustrated embodiment, the trapping members are defined by flexible fingers which are spread apart during initial insertion of the engaging means of the output member therebetween and which return to a non-spread apart condition to restrain rotation of the output member as well as limit axial movement thereof.

In another illustrated embodiment, the means for connecting the output member to the plunger unit is a threaded connection, preferably of the self-locking type. Further, the coil assembly includes means for defining an access to the bore so as to allow rotation of the plunger unit by a tool which is adaptable for use in rotating the plunger. This means preferably includes a plug which is press-fit in the coil assembly and is constructed to eliminate air gaps between the plug and coil assembly.

Among the other objects of the present invention are, therefore, the provision of an improved adjustable electromagnetic actuator; the provision of an electromagnetic actuator in which the stroke of a movable armature assembly therein is adjustable; the provision of an electromagnetic actuator of the last-noted type in which the armature assembly includes a plunger and an output member in which the former is relatively rotatable with respect to the latter and upon relative rotation therebetween the output member and the plunger can move with respect to each other along a given axis and thereby allow stroke adjustment of the plunger; the provision of an electromagnetic actuator in which restraining means are provided for restraining rotation of the output member; the provision of an improved actuator of the last-noted type wherein the restraining means is connected to a coil assembly of the actuator to provide a self-contained unit; the provision of an improved electromagnetic actuator in which connection of the output member and plunger is maintained in a predetermined angular orientation to facilitate assembly thereof to a shutter mechanism or the like; the provision of an improved electromagnetic actuator in which the restraining means includes a pair of spaced-apart flexible trapping fingers; and, the provision of a plug having a press-fit connection to the coil assembly and an access opening therethrough which facilitates use of a tool for rotating the plunger.

Other objects and further scope of applicability of the present invention will become apparent from the detailed description to follow when taken in conjunction with the accompanying drawings in which like parts are designated by like reference numerals throughout the several views.

DETAILED DESCRIPTION

Figure 1:
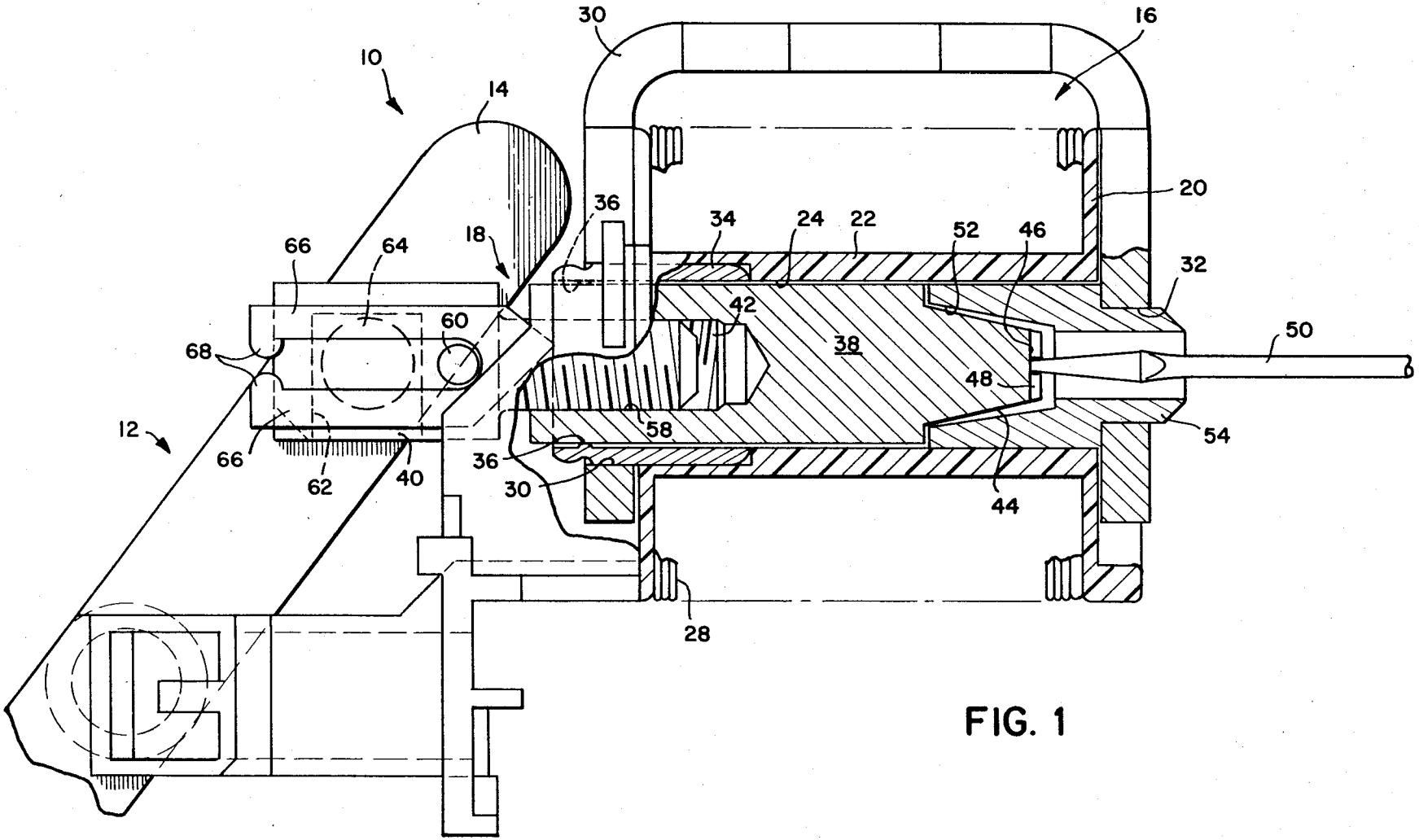
FIG. 1 is a side elevational view partly in section showing the improved electromagnetic actuator of the present invention in one condition; and, FIG. 2 is a view similar to FIG. 1, but showing the actuator in an adjusted condition.
Figure 2:
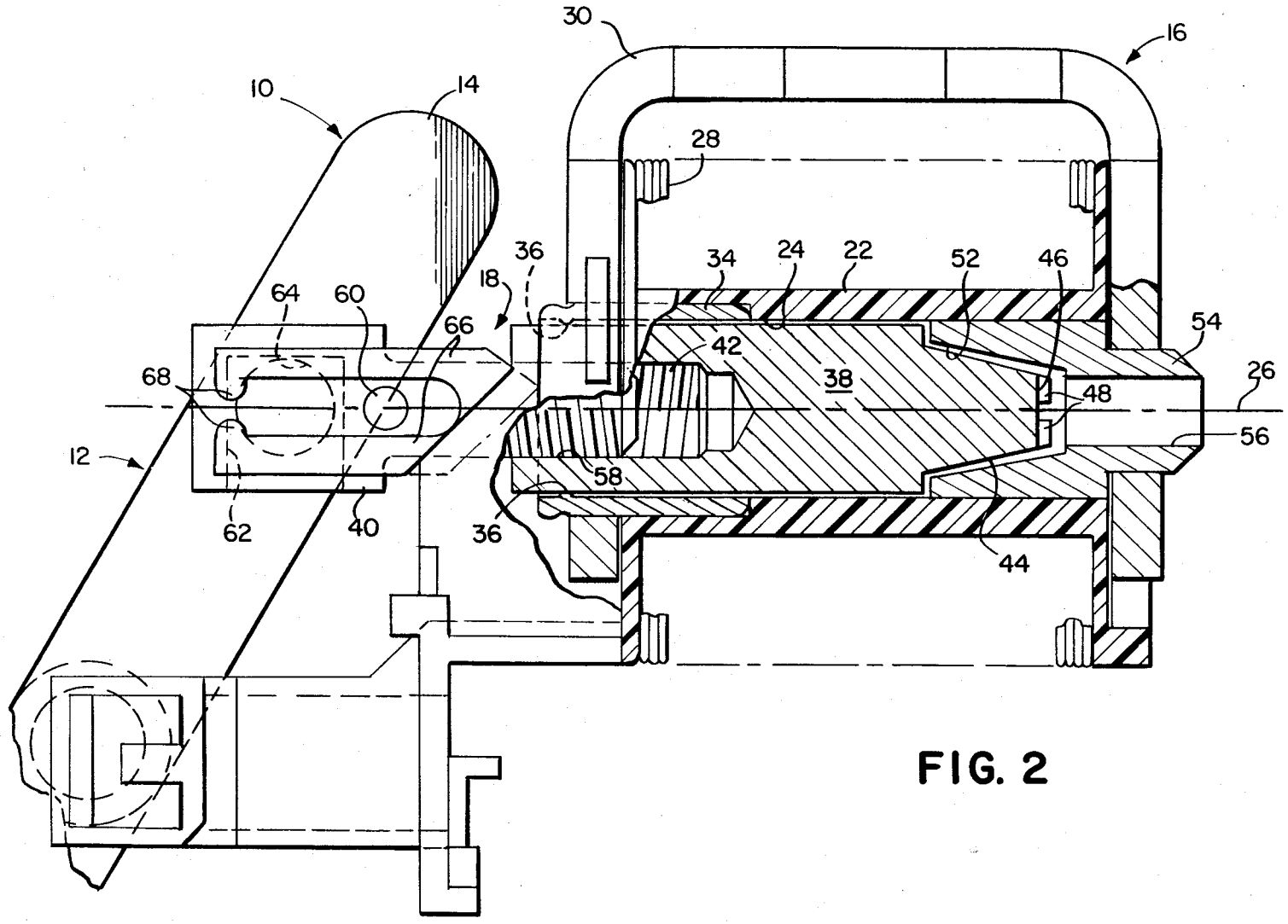

Reference is now made to FIGS. 1 and 2 for showing the improved electromagnetic actuator 10 of the present invention. In the illustrated embodiment, the electromagnetic actuator 10, as will be described, is used for controlling operation of a shutter mechanism generally indicated by reference numeral 12. Although the electromagnetic actuator 10 will be described for use in controlling a shutter mechanism, it will be appreciated that the actuator can control any movable workpiece. Included in the shutter mechanism 12 is a walking beam 14 pivotally mounted to a base block casting (not shown) of a camera. Connected to the walking beam 14 is a pair of so-called scanning type shutter blades, also not shown. Each has a selectively shaped aperture opening, and during an exposure interval the blades will move simultaneously and in correspondence with each other to define a symmetrically configured and progressively variable effective aperture opening over a camera light entering opening. In such a system, the blades are driven to an unblocking condition by a spring mechanism and are driven back to the blocking condition upon energization of the electromagnetic actuator 10.

Referring now in detail to the actuator 10, it includes essentially a coil assembly 16 and, movably disposed therein, an armature assembly 18. The armature assembly 18 is directly coupled to the walking beam 14 for purposes of driving the shutter blades.

Included in the coil assembly 16 is a unitary bobbin 20 made of a suitable non-magnetic plastic material. The bobbin includes a core section 22 which provides means for defining a bore 24 having a longitudinal axis 26. The bore 24 serves to slidably support the armature assembly 18 for axial translation. With the bore 24 having a uniform internal diameter, there is less of a tendency of having the armature assembly misaligned therewithin.

An energizeable field coil 28 is wrapped about the core section 22 so as to extend along and surround the bore 24. The field coil 28 is connected to a suitable source of power (not shown) for energizing the former. Upon energization an electromagnetic field is created which cooperates with the armature assembly 18 to drive the latter from an extended position (not shown) to the retracted positions shown in FIGS. 1 and 2.

Attached to the bobbin 20 is a generally U-shaped metal frame 30, the latter of which is also connected to the base block casting. The frame 30 has a pair of openings 32 axially aligned with the bore 24. The frame 30 forms part of a magnetic circuit between opposite ends of the coil assembly 16.

Connected to the bobbin 20 and disposed partly within the bore 24 is a tubular flux guide 34. The flux guide 34 is disposed within a recess formed in and adjacent the open end of the core section 22. In this arrangement, the flux guide 34 has its internal diameter the same as that of the remainder of the bore 24. The flux guide 34 is made of a ferromagnetic material and forms part of the magnetic circuit of the actuator 10 and facilitates formation of an air gap around the armature assembly. Towards this end, there is formed a plurality of circumferentially spaced-apart protrusions 36 closely adjacent the open end of the guide 34. These protrusions 36 are adapted to slidably contact the periphery of the armature assembly 18 and serve to reduce sliding friction and to concentrate the lines of flux passing through the actuator 10.

Now reference is made back again to the armature assembly 18. It is seen to include a plunger member or unit 38 and an output member or yoke 40. The plunger 38 is made of a suitable ferromagnetic material having at one end thereof an internally threaded bore 42 and at the other end a frusto-conical head portion 44. The plunger 38 is capable of independent axial and rotational movement. Formed at the end of the head portion 44 is a surface conformation 46 having a pair of transverse grooves 48 which are sized and configured to cooperate with a tool 50 (FIG. 1) in a manner to be described. The head portion 44 is shaped to be received within a complementary shaped recess 52 of plug 54. This plug 54 can also be made of a ferromagnetic material and is press-fit into opening 32. In this regard, the plug has a periphery which is substantially continuously in contact with the frame. This eliminates air gaps between the frame and plug which would provide a less efficient actuator. Because of the press-fit connection there is no air gap existing between the frame 30 and the plug 54. Such an arrangement effects greater actuator efficiency. As noted previously, since the plunger 38 is to be directly moved for adjustment purposes there is no need for a threaded plug to provide for adjustment. Centrally formed in the plug 54 is an enlarged and elongated access opening 56. The access opening 56 is sized to accommodate the tool 50 as well as to permit venting of the bore 24 during movement of the armature assembly 18.

The armature assembly 18 includes the yoke 40 and has a stem portion which is threadedly connected as at 58 to the bore 42. This threaded connection is preferably of the lock-nut type and assists in maintaining the plunger 38 and the yoke 40 in a desired angular position with respect to each other when the plunger is not being rotated. Extending from one side of the yoke 40 is a guiding finger or pin 60. The other side of the yoke 40 is a rectangular recess 62 for receiving a walking beam pin 64. Thus, the armature assembly 18 is connected directly to the shutter mechanism 12 for imparting movement to the latter.

For restraining rotational movement of the yoke 40 and for limiting axial translation of the armature assembly 18 there is provided a pair of trapping members or fingers 66 which extend axially from the bobbin 40. The trapping fingers 66 are flexible and resilient and thus facilitate insertion of the armature assembly. The fingers 66 have rounded end portions 68 which limit axial displacement of the armature assembly 18. During insertion of the armature assembly 18 into the bore 24 the guiding pin 60 will engage the end portions 68 and spread apart the fingers 66. The fingers 66 return to the illustrated non-spread-apart position so as to entrap the pin 60. As is apparent, the fingers 66 are spaced apart by a distance to insure that the yoke assembly 40 will be unable to rotate when the plunger 38 is rotated. As will be explained presently, this facilitates adjustment of the travel or stroke of the armature assembly 18. Advantageously, the armature assembly 18 is captured by the fingers 66. This tends to maintain a desired rotational orientation of the armature assembly 18. Thus, during assembly of the actuator 10 the recess 62 can be properly positioned for direct coupling to the walking beam pin 64. Since the fingers 66 capture the armature assembly and also maintain a desired orientation of the latter, this assembly operation is facilitated. Moreover, during rotation of the plunger for adjustment purposes the yoke 40 cannot rotate. This relieves the shutter blades from rotational or bending stresses during operation of the actuator, but especially during adjustment of the armature assembly.

Prior to an explanation of stroke adjustment though it will be appreciated that energization of the field coil 28 will cause the plunger 38 to move inwardly to and against the plug 54. In the present embodiment, the plunger 38 is designed to extend outwardly of the coil assembly under the influences of the spring-biased shutter mechanism when the latter is operable to initiate an exposure interval. Once a desired exposure is reached, an exposure control network (not shown) is responsible for energizing the field coil 28. Such energization is sufficient to retract the plunger 38 to the positions shown in FIGS. 1 and 2. Plunger retraction will cause the walking beam 14 to move the shutter blades to their scene blocking condition to thereby terminate the exposure interval.

To effect stroke adjustment of the armature assembly 18, the plunger 38 is rotated while the yoke 40 is rotationally restrained. Towards this end, the tool 50 extends through the plug 54 and engages one of the grooves 48. Rotation of the plunger 38, in one direction, will cause axial displacement between it and the yoke 40. In this regard, note the position of the yoke 40 and its pin 60 in FIGS. 1 and 2. This is because the threaded connection between the plunger 38 and the yoke 40 coupled with the fingers 66 restraining rotation of the yoke convert the rotational displacement of the plunger into axial relative movement between the yoke and the plunger. Because the yoke 40 is so displaced, it will change the stroke of the plunger 38. Rotation of the plunger 38 in the opposite direction will cause it and the yoke 40 to move axially in the opposite direction relative to each other. Advantageously, there is provided a convenient and simple arrangement for adjusting armature stroke by rotating the armature itself.

Since certain changes may be made in the above-described apparatus without departing from the scope of the invention herein involved, it is intended that all matter contained in the description or shown in the accompanying drawings shall be interpreted as illustrative and not in a limiting sense.

What is claimed is:

1. An adjustable electromagnetic actuator operable to control the displacement of a movable workpiece member, said actuator comprising:

a coil assembly including means defining a bore extending at least partially therethrough and having a given axis, and an energizeable field coil at least partially surrounding said bore;

an armature assembly including a plunger disposed in said bore and being movable along said given axis in response to energization of said field coil, said armature assembly including an output assembly which is adapted to be connected to said workpiece member;

means operatively associated with one of said output assembly or said plunger for restraining rotational movement of said one with respect to the other; and, means connecting said output assembly to said plunger for allowing said plunger and said output assembly to move conjointly along the given axis and for allowing relative rotation therebetween when said one cooperates with said restraining means and the other of said plunger or said output assembly is rotated such that they are displaced in relationship to each other along the given axis to thereby allow stroke regulation of said armature assembly said restraining means includes a pair of spaced-apart trapping members connected at one end portion to said coil assembly, and said output assembly includes means for engaging said trapping members, whereby said output assembly cannot rotate such that said output assembly is non-rotational during stroke regulation and also is maintained in a preselected angular orientation for facilitating assembly thereof to said workpiece member.

2. The actuator of claim 1 wherein said engaging means is a projection which is generally perpendicular to said trapping members.

3. The actuator of claim 2 in which said trapping members comprise elongated fingers of flexible material extending parallel to said given axis with the distal ends thereof turned in facing relation whereby said projection can spread-apart said fingers from an original condition during entry of said projection therebetween and move back to a non-spread-apart condition to limit displacement of said armature along the given axis as well as provide for a self-contained actuator.

4. The actuator of claim 1 in which said connecting means is defined by a threaded connection between said plunger and said output assembly.

5. The actuator of claim 1 in which said coil assembly includes a plug member which has a surface thereof in substantially continuous engagement with said bore defining means so as to thereby eliminate air gaps between said plug member and said bore defining means.

6. The actuator of claim 5 in which said plug has an opening therethrough which permits a tool to engage a surface of said plunger in said bore so as to rotate said plunger.

7. An adjustable electromagnetic actuator energizeable to control the displacement of a movable workpiece, said actuator comprising:

a coil assembly having an energizeable field coil extending around a bore;

an armature assembly including a plunger member of ferromagnetic material disposed in said bore for displacement along the axis thereof, and an output member coupled to a leading end of said plunger member and configured for connection to the workpiece for control thereof in accordance with energization of the actuator, said plunger member and output member being coupled together by a threaded arrangement in which the distance between said members are varied by relative rotation therebetween; and, rotation restraining means operatively associated with said coil assembly and one of said members for restraining rotation of said one member when the other member is rotated for regulation of the stroke of said armature assembly.

8. The actuator of claim 7 wherein said output member is operatively associated with said rotation restraining means such that it is not only rotationally restrained during stroke regulation, but also maintained in a predetermined orientation to facilitate coupling to said workpiece and relieve said workpiece of any rotational stress therefrom during operation of said actuator.

9. The actuator of claim 7 wherein said rotation restraining means further includes means for limiting displacement of said one member along said axis of said bore so as to maintain said armature and said coil assembly as a unitary assembly.

10. An adjustable electromagnetic actuator energizeable to control the displacement of a movable workpiece, said actuator comprising:

a coil assembly having an energizeable field coil extending around a bore;

an armature assembly including a plunger member of ferromagnetic material disposed in said bore for displacement along the axis thereof, and an output member coupled to a leading end of said plunger member and configured for connection to the workpiece for control thereof in accordance with energization of the actuator, said plunger member and output member being coupled together by a threaded arrangement in which the distance between said members are varied by relative rotation therebetween; and, restraining means connected to said coil assembly for restraining rotation of said output member when the plunger member is rotated for regulation of the stroke of said armature assembly, and for restraining axial displacement of said armature assembly with respect to said coil assembly to thereby provide a self-contained unit.

11. An adjustable electromagnetic actuator operable to control the displacement of a movable workpiece member, said actuator comprising:

a coil assembly including means defining a bore extending at least partially therethrough and having a given axis, and an energizeable field coil at least partially surrounding said bore;

an armature assembly including a plunger disposed in said bore and being movable along said given axis in response to energization of said field coil, said armature assembly including an output assembly which is adapted to be connected to said workpiece member;

means operatively associated with said coil assembly and said output assembly for restraining rotational movement of said output assembly with respect to said plunger, said restraining means includes a trapping assembly; and, means connecting said output assembly to said plunger for allowing said plunger and said output assembly to move conjointly along the given axis and for allowing relative rotation therebetween when said output assembly cooperates with said trapping assembly to restrain rotation of the latter while said plunger is rotated during stroke regulation such that said plunger and said output assembly are displaced in relationship to each other along the given axis to thereby allow stroke regulation of said armature assembly.

* * * * *